United States Patent [19]

Salmon et al.

[11] 4,211,331

[45] Jul. 8, 1980

[54] MERCHANDISING DISPLAY

[75] Inventors: Peter C. Salmon; Christopher Kidd, both of Port Washington, N.Y.

[73] Assignee: Consumer Promotions, Inc., White Plains, N.Y.

[21] Appl. No.: 855,651

[22] Filed: Nov. 30, 1977

[51] Int. Cl.[2] ..... A47F 5/02

[52] U.S. Cl. ..... 211/13; 211/163

[58] Field of Search ..... 211/13, 70, 144, 131, 211/77, 78, 163; 248/DIG. 2, 450; 108/103; 312/202, 252, 135, 223, 234; 52/28; 362/431

[56] References Cited

U.S. PATENT DOCUMENTS

| | | | |
|---|---|---|---|
| 1,476,860 | 12/1923 | Vergeer | 248/450 |
| 1,875,563 | 9/1932 | Cooke et al. | 211/1.5 |
| 2,052,755 | 9/1936 | Duffy | 52/28 X |
| 2,808,941 | 10/1957 | Foster | 211/13 |
| 2,816,666 | 12/1957 | Nadel | 211/13 |
| 2,936,897 | 5/1960 | Bloch | 211/13 |
| 2,950,155 | 8/1960 | Schick | 312/202 |
| 3,178,246 | 4/1965 | Riles | 312/257 SK |
| 3,226,907 | 1/1966 | Gregoire | 52/28 X |
| 3,264,462 | 8/1966 | Haggstrom | 211/13 X |
| 3,756,421 | 9/1973 | Wilkins | 211/163 |
| 3,884,357 | 5/1975 | Bloch | 211/163 |
| 3,891,092 | 6/1975 | Surrette et al. | 211/163 |

FOREIGN PATENT DOCUMENTS

| | | | |
|---|---|---|---|
| 2257247 | 8/1975 | France | 211/163 |

*Primary Examiner*—William H. Schultz
*Attorney, Agent, or Firm*—Alan H. Levine

[57] ABSTRACT

A merchandising display comprising a vertical post and at least two vertically spaced apart support members rotatably mounted by bearings on the post. A plurality of tongues project horizontally in different directions from each support member. A plurality of merchandise—holding cases are carried by the support members, each case having two pockets for accommodating one tongue of each support member. The tongues and pockets are formed with cooperable locking means to secure the cases to the support members. The post has an angle-shaped cross-section, and each bearing has a portion non-rotatably accommodating the post. Each case has a removable merchandise-holding front panel, which is preferably translucent, and the back of each case is open to transmit light to the panel from a light source mounted on the post. Each front panel may have a plurality of pairs of horizontally-aligned holes for accommodating the temples of a pair of sunglasses being displayed, fixed canopies projecting rearwardly from the panel over each hole serving to prevent downward rotation of the sunglasses portion exposed on the exterior of the panel. Two pairs of support members may be provided for supporting two tiers of cases. Adjacent support members of the two tiers are non-rotatably joined to each other with a single bearing between them.

14 Claims, 11 Drawing Figures

FIG.1
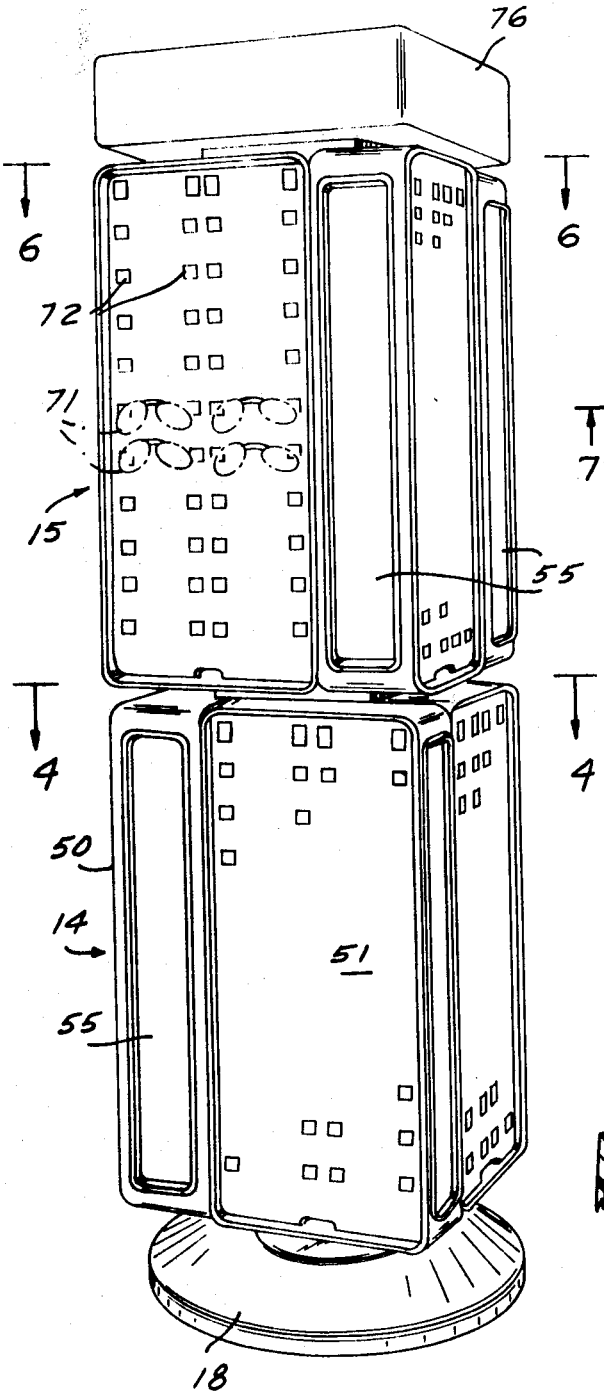
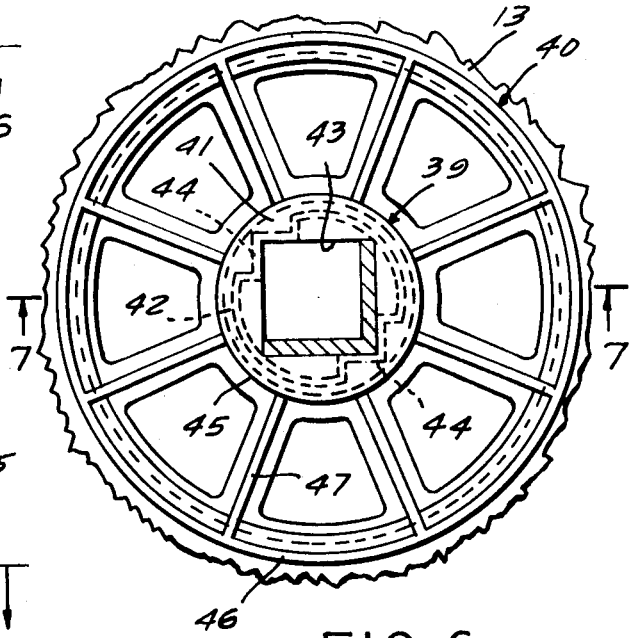
FIG. 6
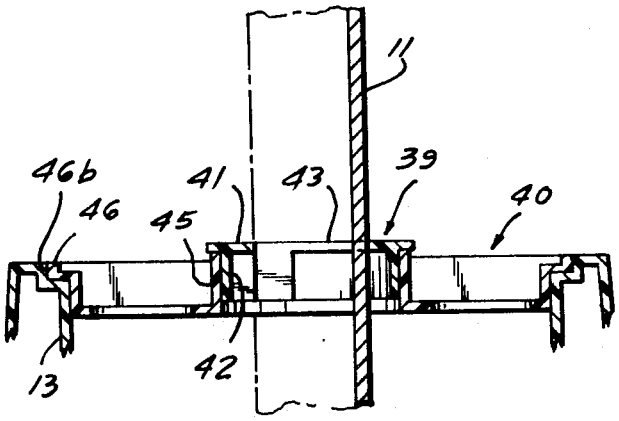
FIG.7

FIG. 8
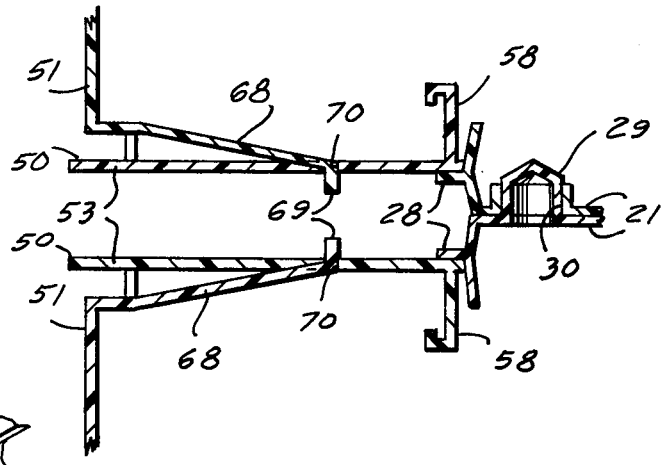
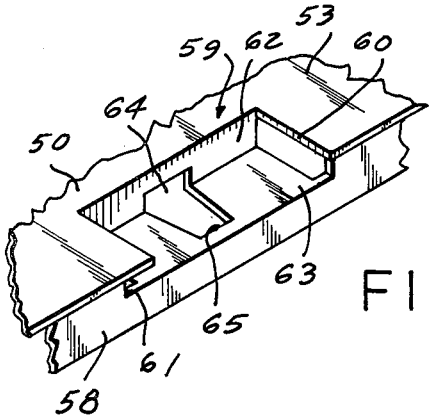
FIG. 10
FIG. 11
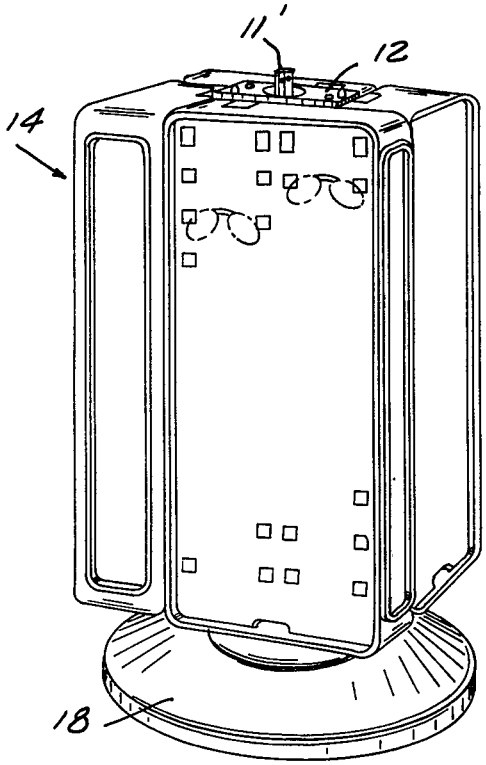
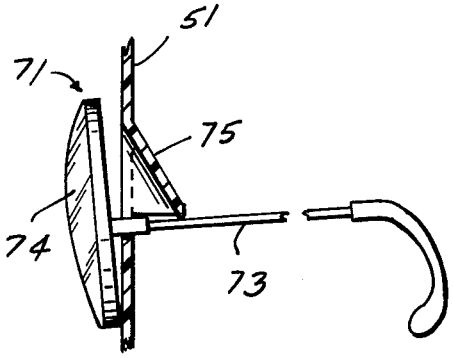
FIG. 9

MERCHANDISING DISPLAY

This invention relates to merchandising displays, and more particularly to displays of modular construction. The invention will be described as a display for merchandising sunglasses but in many respects the invention has broader significance and may be used with other types of merchandise.

It is an object of the invention to provide a rotatable merchandising display in which outer merchandise-holding cases are mounted on interior support members which in turn are rotatably mounted by means of bearing members on a central vertical post.

It is another object of the invention to provide such a merchandising display wherein all the outer cases are identical, and all the interior support members are identical.

It is a further object of the invention to provide such a merchandising display wherein the outer cases can be assembled and interlocked with the support members without the use of tools.

It is an additional object of the invention to provide such a display wherein the vertical post has an angle-shaped cross-section, as opposed to use of a tubular post, so that portions of the bearing members can readily be non-rotatably arranged with respect to the post, and so that electric wires to a light source mounted on the post can run along an exterior surface of the post without interfering with the bearing members.

It is another object of the invention to provide such a display which can be made in the form of either one or two tiers of merchandise-holding cases.

It is a further object of the invention to provide such a display wherein the merchandise-holding front panel of each of the cases is readily removable, together with its merchandise, from the remainder of the case, and if desired replaceable with another similar panel.

It is an additional object of the invention to provide such a display particularly adapted for merchandising sunglasses wherein the front panel has holes through which the temples of the sunglasses are passed, the rear face of the panel being formed with means for preventing the portion of the sunglasses exposed on the exterior of the panel from tilting downwardly.

Additional objects and features of the invention will be apparent from the following description in which reference is made to the accompanying drawings.

In the drawings:

FIG. 1 is a perspective view of an assembled two tier merchandising display according to the present invention;

FIG. 6 is a fragmentary horizontal cross-sectional view, on an enlarged scale, taken on line 6—6 of FIG. 1;

FIG. 7 is a vertical cross-sectional view taken on line 7—7 of FIG. 6;

FIG. 8 is a fragmentary vertical cross-sectional view taken on line 8—8 of FIG. 4;

FIG. 9 is a fragmentary vertical cross-sectional view through a front panel of one of the merchandise-holding cases;

FIG. 10 is a fragmentary perspective view of one of the pockets formed in each case of the display; and FIG. 11 is a view similar to FIG. 1 of a single tier embodiment of the invention.

Figures 2, 3A, 3B:
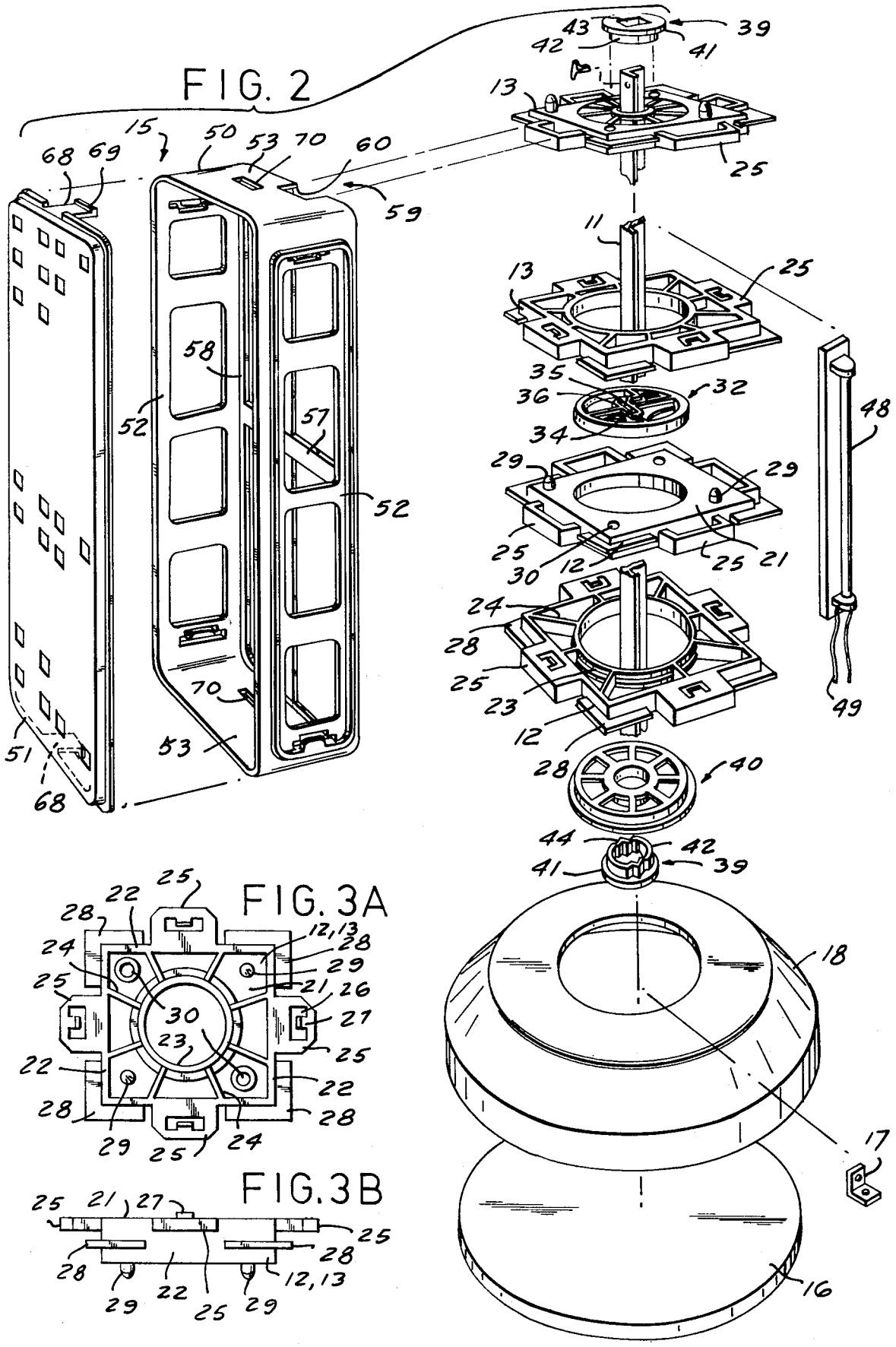
FIG. 2 is an exploded perspective view of the display showing only one of the merchandise-holding cases.
FIG. 3A is a face view of one of the interior support members.
FIG. 3B is a side elevational view of the support member.

The merchandising display chosen to illustrate the present invention comprises generally (see FIGS. 1 and 2) a vertical central post 11, a lower pair of support members 12 and an upper pair of support members 13, all rotatably supported around the post, and two tiers of merchandise-holding cases 14 and 15 mounted on the pairs of support members 12 and 13, respectively.

Post 11 is held upright by a flat circular base 16 to which the lower end of the post is fixed by any suitable fasteners, such as one or more angle brackets 17. A cover 18 fits over base 16 to improve the appearance of the display. Post 11 has an angle-shaped cross-section (see FIG. 4), and may be a length of "angle iron".

All four of the support members 12, 13 are identical, and as may be seen in FIGS. 2, 3A, and 3B are of generally square configuration. The support members may be formed of molded plastic. Each support member 12, 13 includes a body comprising a square horizontal wall 21 which is flat on one face. Projecting substantially vertically from the peripheral edges of the opposite face of wall 21 are four side walls 22. Also projecting from the opposite face of wall 21 is an inner circular wall 23 surrounding a circular central opening in the support member. Circular wall 23 has a stepped configuration defining a relatively wide portion 23*a* (see FIG. 5) of smaller diameter and a relatively narrow portion 23*b* of larger diameter. Extending between wall 23 and side walls 22 are a plurality of strengthening ribs 24.

Figure 5:
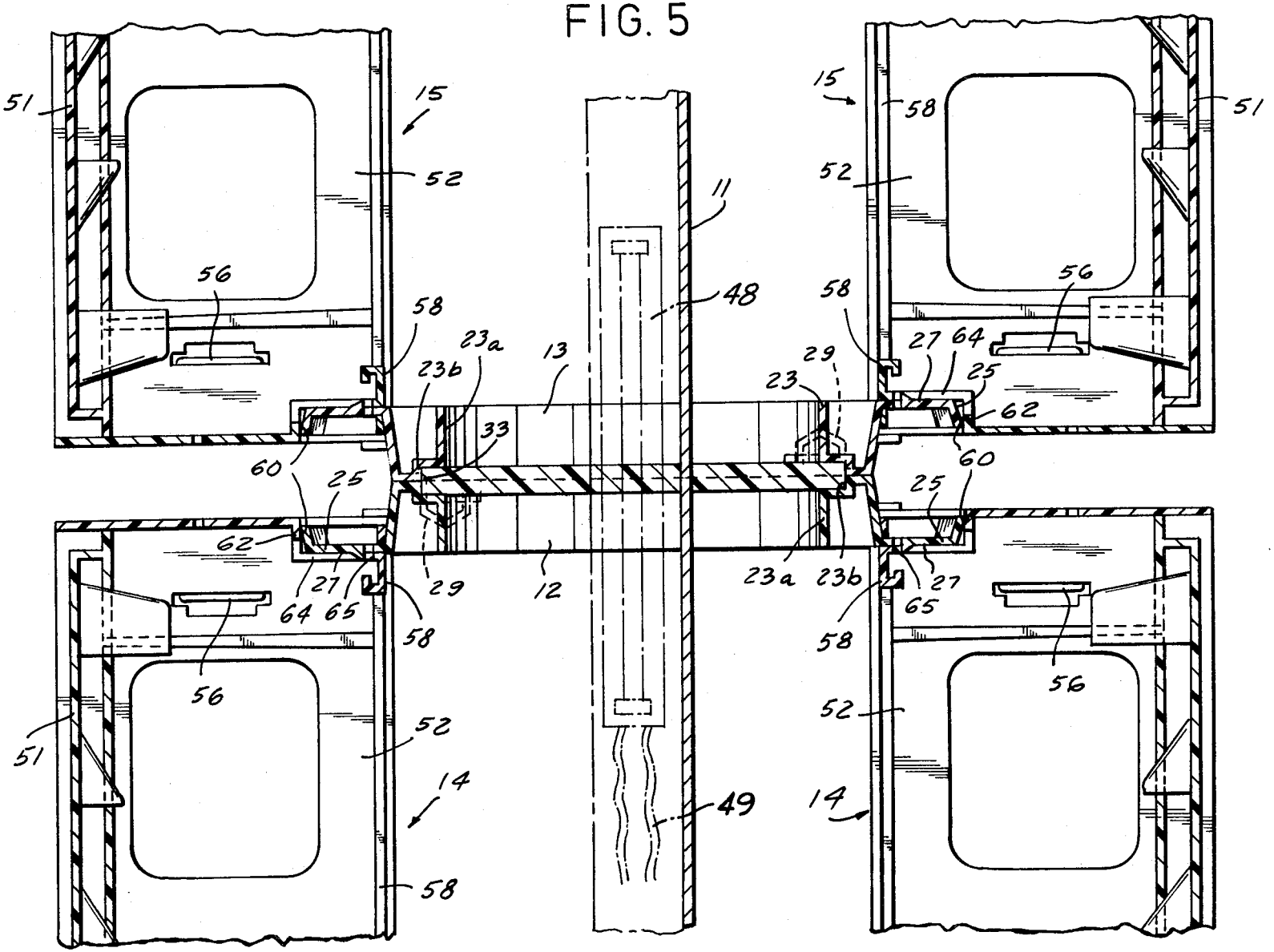
FIG. 5 is a fragmentary vertical cross-sectional view taken on line 5—5 of FIG. 4.

Projecting horizontally from each side wall 22 is a relatively flat, wide tongue 25. Each tongue comprises a horizontal wall which is in effect an extension of horizontal wall 21, and three substantially vertical walls extending along the three exposed edges of the horizontal wall. These vertical walls extend for only a part of the height of side wall 22; hence each tongue 25 has a thickness which is a fraction of the thickness of the support member, as may be seen clearly in FIG. 3B. At its center, the horizontal wall of each tongue is formed with a U-shaped slot 26 defining a locking tab 27, the free end of the locking tab being thickened. Projecting outwardly from each corner of support member 12, 13 is a horizontal L-shaped flange 28, each flange being located at about the midpoint of the thickness of the support member. Projecting vertically from the flat face of horizontal wall 21, near two diametrically opposite corners thereof, are two hollow pins 29. Near its other two corners, wall 21 is formed with two holes 30, each surrounded by a boss, capable of snugly accommodating the pins 29 of another support member when the two are joined flat face to flat face as shown in FIGS. 5 and 8.

Bearing means are provided for rotatably mounting support member 12, 13 about post 11. The bearing means are of two types, one type being employed with the lowermost support member 12 and with the uppermost support member 13, and the other type being employed with the upper support member 12 and the lower support member 13. In the latter case, a single bearing member 32 mounts both the upper support member 12 and lower support member 13 to post 11.

Figure 4:
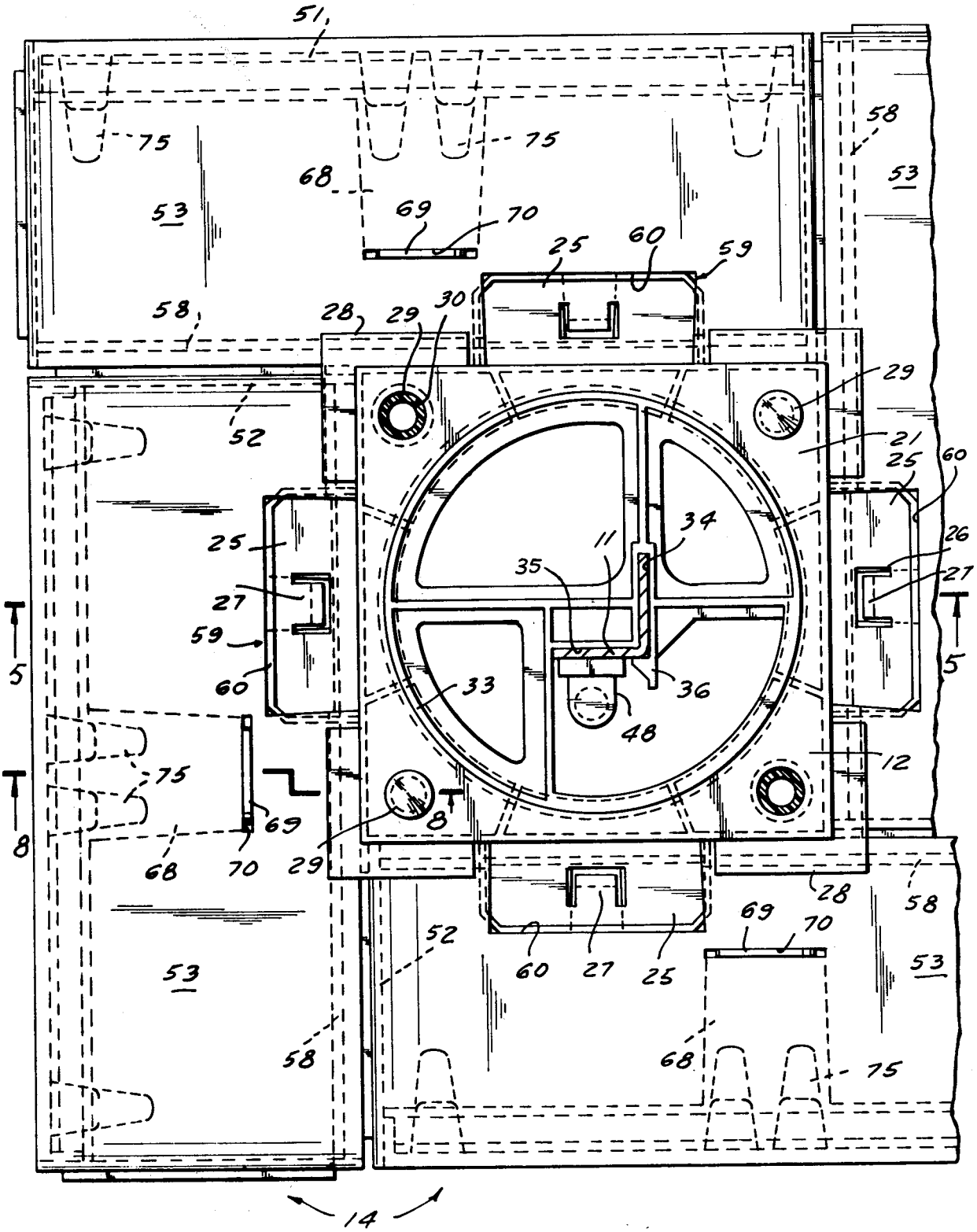
FIG. 4 is a fragmentary horizontal cross-sectional view, on an enlarged scale, taken on line 4—4 of FIG. 1.

Bearing member 32 (FIGS. 2, 4, and 5), which may be a single piece of molded plastic, comprises a circular outer rim 33. Within rim 33 is a spoke arrangement of odd shape defining near its center a slot 34 and a surface 35 perpendicular to the slot. One wall of slot 34 extends beyond surface 35 and terminates in a finger having a ledge 36 at its end. Surface 35 and the wall of slot 34 adjacent to it are adapted to fit against the two internal faces of angle-shaped post 11, and the other wall of slot 34 and ledge 36 are adapted to fit against the two external faces of the post, as best seen in FIG. 4. In this way, bearing member 32 is non-rotatably joined to post 11.

The height of rim 33 is about twice as large as the width of narrow wall portion **23*b* of each support member. Consequently, when the upper support member 12 and lower support member 13 are placed in face-to-face contact, as shown in FIG. 5, rim 33 fits snugly but rotatably within the annular groove defined by the two facing wall portions 23*b* of the two support members. In this way, the two support members are rotatably supported with respect to post 11. At the same time, the two support members are non-rotatable with respect to each other because the pins 29 of each fit into the holes 30** of the other.

The bearing means mounting the lower support member 12 and upper support member 13 to post 11 are identical and each includes an inner bearing member 39 and an outer bearing member 40 (FIGS. 2, 6, and 7), both of which may be made of molded plastic. Inner bearing member 39 comprises a flat circular plate 41, having a square central hole 43, and a generally circular collar 42 projecting from one face of plate 41. The size of hole 43 is such that it snugly accommodates post 11, the external faces of the post fitting against two adjacent sides of the hole. Collar 42 is squared off in two diametrically opposed portions 44 to stabilize the fit of bearing member 39 around post 11. Consequently, bearing member 39 is non-rotatable with respect to post 11.

Outer bearing member 40 comprises a hub 45, snugly but rotatably fitted around collar 42, a circular rim 46, and a series of radial spokes 47 joining the hub and rim. All these parts may be molded as one piece of plastic. Rim 46 has a stepped configuration, so that, as shown in FIG. 7, its smaller diameter portion **46*a* fits snugly but rotatably within the smaller diameter wall portion 23*a* of support member 12, 13, and its larger diameter portion 46*b* fits snugly but rotatably within the larger diameter portion 23*b* of the support member. Thus, outer bearing member 40 is rotatable about inner bearing member 39, and support member 12, 13 is rotatable about outer bearing member 40. The stepped configurations of rim 46 and wall 23 prevent relative axial movement of bearing member 40 and support member 12, 13 in a direction which moves either bearing member 40 toward the other or which moves either of the uppermost support member 13 and lowermost support member 12** away from each other.

If desired, a light source in the form of a florescent lighting strip 48 (FIG. 1) may be mounted on post 11. Preferably, strip 48 is fixed to one of the external surfaces of post 11 adjacent to ledge 36 (see FIG. 4). In this position, lighting strip 48 is located at about the center of the height of post 11, but does not interfere with any bearing member or with rotation of support members 12, 13. The electric wire 49 for strip 48 extends downwardly along the post (see FIG. 5) and through square hole 43 in the lower bearing member 39. Thus, wire 49 also does not interfere with the bearing members or rotation of the support members. The wire 49 extends into cover 18 and out through a suitable hole in the cover so that it can be plugged into an electric outlet. The advantages of using an angle-shaped post 11 is that it provides a flat surface for mounting a light source and permits wire 49 to be run externally of the post. If a tubular post were used, mounting the light source would be more difficult and the wire would have to be threaded through the post.

All the cases 15 are identical, and each includes a rectangular frame 50, having rounded corners, and a front panel 51 (FIGS. 1 and 2). Each frame 50 may be formed as a single piece of molded plastic and each front panel 51 may also be formed of a single piece of molded plastic. Each frame 50 has two relatively long vertical side walls 52 and two relatively short horizontal top and bottom walls 53. As will be seen, the construction is such that either wall 53 may be used as the top wall and either may be used as the bottom wall. Rectangular holes are formed in the side walls 52 simply to save plastic. Projecting outwardly from each side wall is a generally rectangular ridge 54 defining a border within which an advertising card 55 is placed, the ends of the card being held in place by lips 56 (FIGS. 2 and 5) overhanging the end of the region within ridge 54. Since ridge 54 is outwardly of the rectangular holes in side walls 52, the advertising cards 55 hide the holes. The back of each frame 50 is open, except for a narrow flange 58 (FIGS. 3, 4, and 5) projecting perpendicularly inwardly from walls 52 and 53, and two crossed rigidifying strips 57 (FIG. 2) extending between the flange 58 adjacent to walls 52 and 53, respectively.

Each of the top and bottom walls 53 is formed with a pocket for snugly accommodating one of the tongues 25 projecting from support members 12, 13. As seen in FIGS. 2, 4, 5, and 10, each pocket 59 is defined by a rectangular notch 60 in wall 53, the notch extending to the rear edge of the wall, a rectangular notch 61 in flange 58, a vertical wall 62 extending from the rear edge of notch 60, and a horizontal wall 63 extending from the lower edge of notch 61, walls 62 and 63 meeting at their inner edges. A rectangular hole 64 is formed in wall 63 and extends also into wall 62. Notch 60 is shorter than notch 61 so that the portions of wall 53 defining the end edges of notch 60 overhang wall 63 and the ends of notch 61.

The length of notch 61 is slightly larger than the width of a tongue 25, and the distance from wall 63 to the opposite faces of the overhanging portions of wall 53 is slightly larger than the thickness of a tongue 25. Thus, a tongue 25 fits snugly within pocket 59, and to a depth within the pocket defined by wall 62. As a tongue 25 is pushed into a pocket 59, the thickened free end the locking tab 27 carried by the tongue snaps over edge 65 of hole 64 (see FIG. 5) and prevents the tongue from being accidently removed from the pocket. The tongue can be resiliently bent so that its thickened end does not meet hole edge 65, in order to permit disassembly of the tongue and pocket.

When assembling the display, each case 14 is mounted on the two vertically spaced apart support members 12 by inserting one tongue 25 of each support member into the two pockets 59 of the case. In the same way, each case 15 is mounted on the two support members 13. As may be seen in FIG. 4, pockets 59 are offset from the vertical centerline of their respective frame 50.

In this way, when all four cases are assembled on their respective support members, the back of each case overlaps one side wall 52 of an adjacent case. As a result, the overall cross-sectional configuration of the four assembled cases is a square.

Since cases 14 and 15 are mounted on post 11 exclusively by means of support members 12, 13 and bearing members 32 and 39, 40, the assembled cases are rotatable about post 11. The two tiers of cases 14 and 15 cannot rotate with respect to each other because of the non-rotatable interengagement of the middle support members 12 and 13 which was described above.

Each front panel 51 has two fingers 68 (FIGS. 2, 4, and 8) projecting rearwardly from its top and bottom edges, respectively. A ridge 69 projects outwardly from the free edge of each finger, and is adapted to be accommodated in a slot 70 in each wall 53. Fingers 68 are resilient permitting them to be pressed toward each other as panel 51 is inserted into the front of frame 50, until ridges 69 reach and snap into slots 70. Ridges 69 can be pressed back through slots 70 to permit removal of panel 51 and, if desired, replacement with another similar panel.

In the present example, the display is intended for merchandising sunglasses 71. Therefore, panel 51 is formed with two columns of horizontally aligned pairs of holes 72. The temples 73 (FIG. 9) of a pair of sunglasses are passed through each horizontally aligned pair of holes 72, leaving the lens portion 74 of the sunglasses exposed on the outer face of panel 51. Projecting rearwardly from the top and side edges of each hole 72 is a canopy-like abutment 75 (FIGS. 4 and 9). The weight of lens portion 74 of the sunglasses tends to pivot the sunglasses forwardly and downwardly, i.e., in a counterclockwise direction in FIG. 9. However, this movement is resisted by engagement of each temple 73 with the bottom edge of its respective abutment 75. As a result, the sunglasses are prevented from falling out of the display.

Preferably, front panels 51 are made of translucent material so that they are illuminated from behind by light from source 48 passing through the open backs of frames 50. Consequently, the sunglasses 71 are seen against an illuminated panel, making the display especially attractive. A decorative top 76 (FIG. 1) is assembled upon the cases 15 in any suitable manner.

The merchandising display of the invention has been described above in the form of a two tier unit, i.e., having two tiers of cases 14 and 15. In this form, it is most useful as a floor display. However, the display can take the form of a single tier unit, as shown in FIG. 11, for use on a store counter. The display of FIG. 11 is in all respects like that of FIGS. 1–10, except that post 11' is shorter than post 11, only four cases 14 are employed, and bearing member 32 is eliminated along with the two middle support members 12 and 13. Only two support members 12 are employed together with two sets of bearing members 39 and 40. A top similar to top 76 may be carried by cases 14.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed:

1. A merchandising display comprising:

(a) a vertical post having an angle-shaped cross section, (b) at least two vertically spaced apart support members mounted on said post, (c) bearing means mounting each of said support members on said post for rotation of each support member in a horizontal plane, each bearing means being non-rotatably secured to said post and at least the lower of said bearing means being spaced from a surface of said post, (d) a plurality of merchandise-holding cases carried by said support members in spaced relation to said post, (e) an electric light fixture fixed to one of the flat surfaces of said angle-shaped post, and (f) an electric wire from said light fixture extending along the length and externally of said post and through the space between the lower of said bearing means and said post.

2. A merchandising display as defined in claim 1 wherein said bearing means has a circular outer contour, and each of said support members has a circular central opening rotatably accommodating the outer contour of its respective bearing means.

3. A merchandising display as defined in claim 1 wherein said support members are all identical to each other.

4. A merchandising display as defined in claim 1 wherein each case has a front merchandise-holding panel, and means removably mounting said panel on the remainder of said case.

5. A merchandising display as defined in claim 1 wherein each case has a front merchandise holding panel, said panel being translucent, and the back of each case being open to permit light from said fixture to reach said panel.

6. A merchandising display as defined in claim 1 including two pairs of said support members arranged one above the other on said post, and two tiers of cases carried by said support members.

7. A merchandising display as defined in claim 6 including means interconnecting the upper support member of said lower tier of cases and the lower support member of said upper tier of cases to prevent relative rotation between said support members and hence between said two tiers.

8. A merchandising display as defined in claim 6 including a single bearing means mounting the upper support member of said lower tier of cases and the lower support member of said upper tier of cases on said post.

9. A merchandising display as defined in claim 8 wherein said single bearing means is sandwiched between said upper and lower support members.

10. A merchandising display as defined in claim 1 wherein each of said support members has a plurality of tongues projecting horizontally therefrom in different directions, said support members having the same number of tongues and each tongue of each support member projecting in the same direction as one of the tongues of the other support member, and each of said cases has two spaced apart pockets accommodating two tongues, respectively, of said support members which project in the same direction.

11. A merchandising display as defined in claim 10 including cooperable locking means carried by each of said tongues and each of the pockets of each of said cases for securing each case to two of said support members.

12. A merchandising display as defined in claim 10 wherein each of said support members has a generally square outer contour, one of said tongues projecting perpendicularly from each side of the square.

13. A merchandising display as defined in claim 12 including four cases carried by each spaced-apart pair of support members, each case facing in a direction which is at an 90° angle to the direction in which the cases adjacent to it face, and the back of each case overlapping the side of one of the cases adjacent to it.

14. A merchandising display as defined in claim 1 wherein each case has a front panel, a plurality of pairs of horizontally-aligned holes in said panel for accommodating the temples of sunglasses to be displayed on said panel, and fixed canopies extending over the top of each hole and projecting rearwardly from the rear face of said panel for preventing downward and forward rotation of the sunglasses portion exposed on the exterior of said panel.

* * * * *